United States Patent [19]

Maeshima

[11] Patent Number: 4,470,155

[45] Date of Patent: Sep. 11, 1984

[54] JUMPER

[75] Inventor: Seiichi Maeshima, Nara, Japan

[73] Assignee: Descente Ltd., Osaka, Japan

[21] Appl. No.: 341,121

[22] Filed: Jan. 20, 1982

[30] Foreign Application Priority Data

Mar. 16, 1981 [JP] Japan ..... 56-35439

[51] Int. Cl.[3] ..... A41D 1/02

[52] U.S. Cl. ..... 2/108; 2/102; 2/97; 2/95; 2/87

[58] Field of Search ..... 2/82, 85, 87, 95, 96, 2/97, 102, 2.5, 94, 108

[56] References Cited

U.S. PATENT DOCUMENTS

| | | | |
|---|---|---|---|
| 2,316,983 | 4/1943 | Wulf | 2/97 |
| 4,217,663 | 8/1980 | Goldberg et al. | 2/102 |
| 4,266,297 | 5/1981 | Atkins | 2/2.5 |
| 4,302,850 | 12/1981 | Maeshima | 2/102 |

FOREIGN PATENT DOCUMENTS

| | | | |
|---|---|---|---|
| 2095096 | 3/1981 | Japan | 2/97 |

*Primary Examiner*—Werner H. Schroeder
*Assistant Examiner*—Mary A. Ellis
*Attorney, Agent, or Firm*—Oblon, Fisher, Spivak, McClelland & Maier

[57] ABSTRACT

A jumper which is convertible to a thick type or thin type jumper by detachably attaching a liner therein. Said jumper having a front and back panels and a pair of sleeves extending from the panel, which comprises: a right side constituting an outer face of the front and back panels and sleeves; a lining constituting an inner face of the front and back panels and sleeves, said lining being stitched to the right side at its peripheral edge of the panel so as to form a space between the right side and the lining, said lining having, at the back panel, a slit which communicates to the space; and a liner detachably attached in the space through the slit. The liner can be stably fixed in position in the space by a plurality of snap fasteners and loops provided at cuffs of the liner. Said jumper is excellent in the cold-proof and the waterproof.

2 Claims, 9 Drawing Figures

JUMPER

BACKGROUND OF THE INVENTION

1. Field of the Invention

The present invention relates to new and useful improvement in jumpers, that are to be worn as sportswears such as for skiing, mountain climbing or the like, or as townwears.

2. Description of the Prior Art

Various kinds of the jumpers of this type have heretofore been introduced. Some of them are made of a thick material such as a quilting while the others are made of a thin material. Since they have been inherently produced, from the first, either as a thick type or as a thin type, these jumpers could be used only in a limited range of the ambient temperature. A person who wore a thin jumper could not perfectly protect himself from coldness when the ambient temperature dropped suddenly. On the other hand, a person who wore a thin jumper could not be comfortable when the ambient temperature rose, or when his temperature rose after he worked hard.

Thus, these conventional jumpers were insufficient and inconvenient after sudden change of the temperature. And they were not economical, since they could not be worn for three seasons.

Further, in a quilting jumper filled with down or feather, there was a drawback that a water-proof finish was not possible.

To solve these problems, a convertible jumper has been proposed by the same inventor as that of the present invention in the Japanese Utility Model Application No. 55-113094 filed on Aug. 8, 1980, which is convertible either to a thick jumper or a thin jumper by attaching a liner inside or detaching the liner therefrom. To be more specific, this jumper is a well-known shape having a front and back panels and a pair of sleeves extending therefrom, and comprises an exterior or first side and a lining which constitute an outer face and an inner face of the panels and sleeves of the jumper. The lining is stitched to the exterior side at its peripheral edge so that a space is formed between the lining and exterior side throughout the jumper. A liner for the jumper has a similar configuration to the jumper and comprises a vest portion and pair of sleeve portions engaged to the vest portion by slide fasteners respectively. In order to insert the liner in the space, there is formed a transverse slit at the lining of the back panel. Further, the exterior side of the sleeves is cut off in a circumferential direction so as to form an annular opening in the respective sleeves. The liner can be detachably attached in the space through the slit and annular openings.

In this prior art jumper, however, there remains a drawback that it is troublesome and time-consuming to attach the liner inside or to detach the same therefrom, since the liner, prior to attaching, must be separated to the vest portion and two sleeve portions, and then the vest portion is inserted in the panel space through the slit at the back panel while the sleeve portions are each inserted in the sleeve space through the annular openings. The vest portion and sleeve portions are finally coupled together in the space by the slide fasteners. It must follow the reverse course when the liner is detached from the space. Thus, the attaching and detaching of the liner in this prior art jumper is troublesome and time-consuming.

SUMMARY OF THE INVENTION

Therefore, it is an object of the invention to provie a jumper which overcomes the disadvantages in the prior art jumper.

Another object of the invention is to provide an improved jumper which can be quickly and easily converted to a thick type or thin type jumper by attaching or detaching a liner in accordance with the ambient temperature or a working situation.

Briefly stated, in accordance with the present invention, there is provided a jumper having a front and back panels and a pair of sleeves extending from the front and back panels, said front panel being openable at its front, which comprises: a right side constituting an outer face of the front and back panels and sleeves; a lining constituting an inner face of the front and back panels and sleeves, said lining being stitched to the right side at its peripheral edges of the panels so as to form a space between the right side and the lining, said lining having, at the back panel, a slit which communicates to the space; a liner detachably attached in the space through the slit; and means for fixing the liner in position in the space.

The features which are believed to be novel and characteristic of this invention are set forth with particularly in the appended claims. The invention itself, however, both as to its construction and mode of operation, together with the further objects and advantages thereof, will become more apparent and understandable as the description proceeds, hereinbelow, with reference made to the accompanying drawings wherein like reference characters denote like parts throughout the several views.

DESCRIPTION OF THE PREFERRED EMBODIMENT

Figure 1:
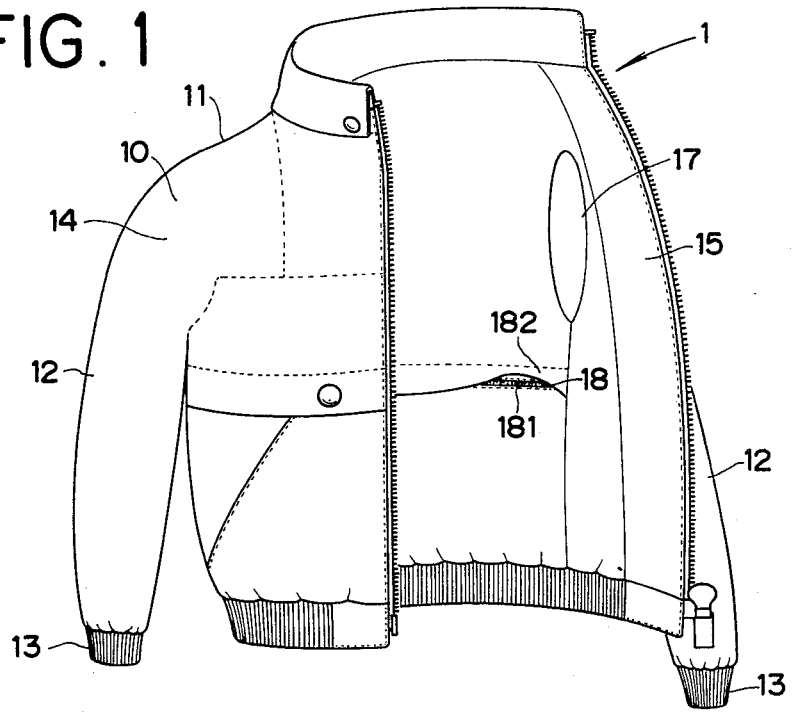
FIG. 1 is a front view showing a jumper according to the present invention, wherein a liner has not been attached therein.
Figure 2:
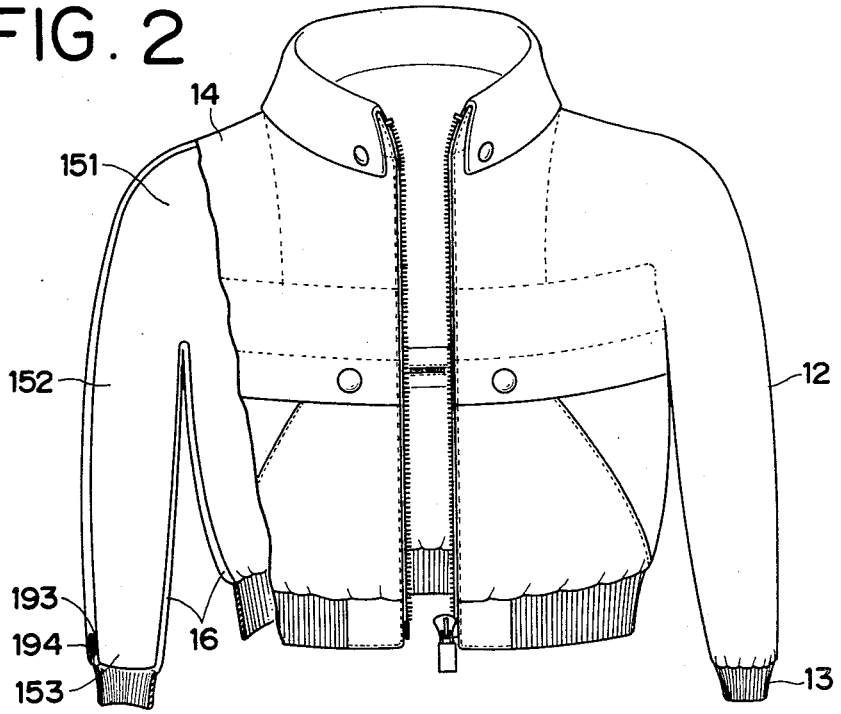
FIG. 2 is a front view, partly in cross section, showing the jumper of FIG. 1.

Referring now to the drawings and FIG. 1 in particular, there is shown a jumper 1 which is of a well-known shape having a front panel 10, a back panel 11, and a pair of sleeves 12 extending from the front and back panels 10, 11. The front panel 10 is made openable at its front by a slide fastener. The pair of sleeves 12 have a cuff 13, respectively, at their free ends. The jumper 1 includes an exterior or first side 14 and a lining 15. The exterior side consists of an outer face of the front and back panels 10, 11 and a pair of sleeves 12 of the jumper 1. Also the lining 15 consists of an inner face of the front and back panels 10, 11 and the pair of sleeves 12 of the jumper 1, and which is divided into a panel lining 151 and a pair of sleeve linings 152 having a cuff 153 at their respective free ends. The exterior side 14 may be preferably a synthetic fabrics which is cold-proof and water-proof.

The lining 15 is stitched to the exterior side 14 along a peripheral edge of the front and back panels 10, 11, so that a space 16 is formed between the exterior side 14 and the lining 15. On the other hand, in the respective sleeves 12 of the jumper, the sleeve linings 152 are not stitched to the exterior side 14, so that the pair of sleeve linings 152 are left free and can be pulled out from a shoulder hole 17 with its inside out, as explained later.

There is formed a slit 18 at the panel lining 151. The slit 18 extends in the transverse direction and is intended for the insertion of a liner, described hereinafter, so that the length of the slit 18 should be enough for the liner passing through. A pair of opposing stringer tapes of a well-known slide fastener 181 are sewed onto the respective upper and lower ends of the slit 18 in such a manner that the slit 18 can be opened or closed by shifting a slider of the slide fastener in the right or left direction, when seen in FIG. 1. Moreover, it is preferable to fold and tuck the lining 15 at the area above the upper end of the slit 18, so as to form a flap 182 which will conceal the slit 18 from view and give a good appearance.

Figure 3:
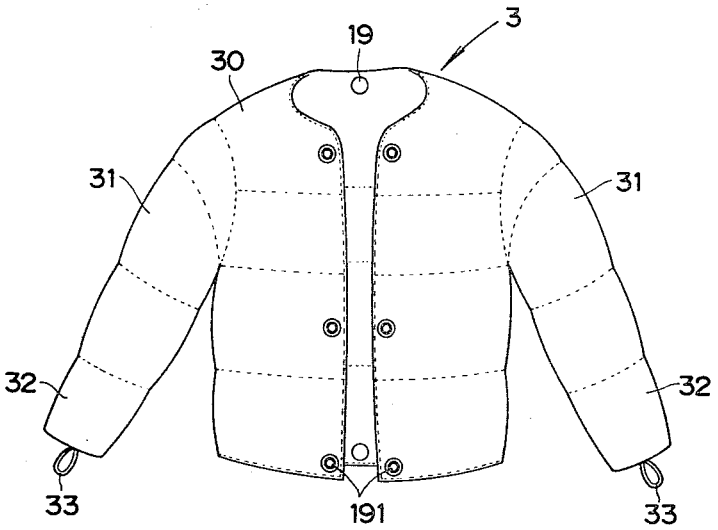
FIG. 3 is a front view showing the liner according to the present invention.

FIG. 3 shows the liner 3. The liner 3 has a similar shape to that of the jacket 1, and has a vest portion 30 and a pair of sleeve portions 31 which extend from the vest portion 30. The sleeve portions 31 have a cuff 32 at their respective free ends. The liner 3 may preferably be, but should not be limited to, a quilting filled with down, feather, synthetic fabric or the like.

Figure 4:
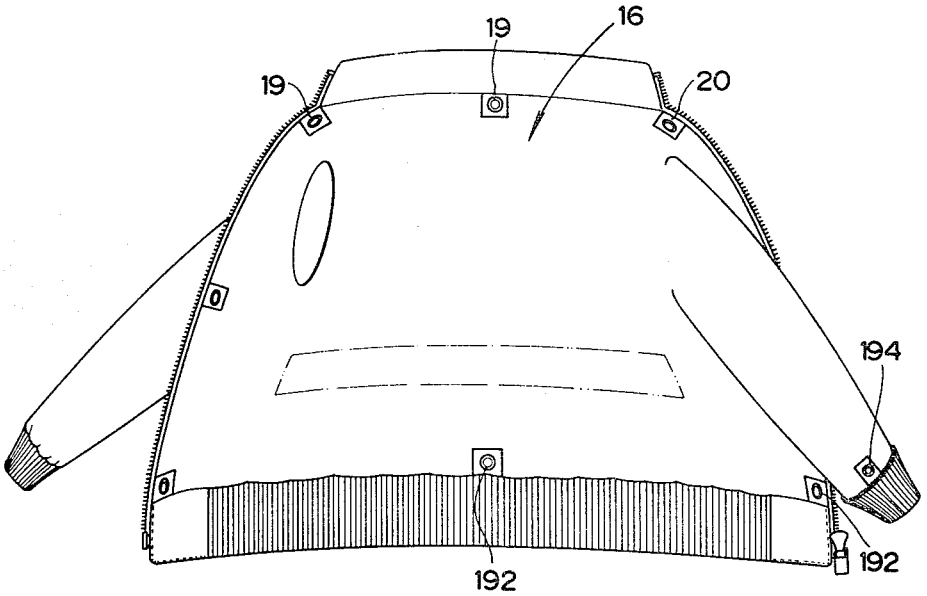
FIG. 4 is an explanatory plan view showing a space formed by a right side and a lining of the jumper, wherein the lining is taken away for the purpose of illustration.

In order to fix the liner 3 in the space 16 after the liner 3 has been inserted therein, fastening means such as snap fasteners 19 are used, as shown in FIG. 4. That is, a plurality of parts such as male snaps 191 of the snap fasteners 19 are spaced along the peripheral edge of the vest portion 30 of the liner 3. Similarly, a plurality of the other parts such as female snaps 192 of the snap fasteners of the same number as the males snaps on the liner 3, are attached onto a strip 20, which are sewed at the peripheral edge of the space 16 where the exterior side 14 and the lining 15 are sewed up together. Said strips 20 are spaced along the peripheral edge thereof in corresponding to the male snap fasteners on the liner when the liner 3 is inserted in the space 16. These male and female parts of the snap fasteners 19 can be fastened after the liner 3 is inserted in the space 16. The liner 3, therefore, can be fixed stably in position and does not shift out of position even when the wearer works hard.

Further, there are also provided a male 193 and female 194 of the snap fastener at the cuff 153 of the sleeve lining 152 and the inner surface of the right side 14 adjacent to the cuff 13 of the jumper 1, so that the sleeve lining 152 can be fixed in position in the sleeve 12 of the jumper 1.

Any other fastening means such as a button and a hole, or a velvet fastener can be used instead of the snap fastener.

In addition to the snap fasteners, a loop 33 is stitched at the cuff 32 of the sleeve portions of the liner 3. The loop 33 is interposed between the male snap fastener 193 and the female snap fastener 194 provided at the cuff 153 of the sleeve lining 152 and at the inner surface of the exterior side 14 adjacent to the cuff 13 of the jumper 1, when the snap fastener is fastened. Therefore, the sleeve portions 31 of the liner can be stably fixed in position in the sleeves 12 of the jumper 1.

Figure 5:
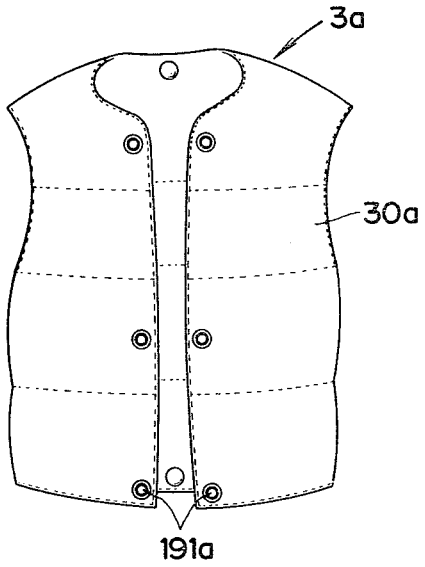
FIG. 5 is a front view showing a modification of the liner.
Figure 6:
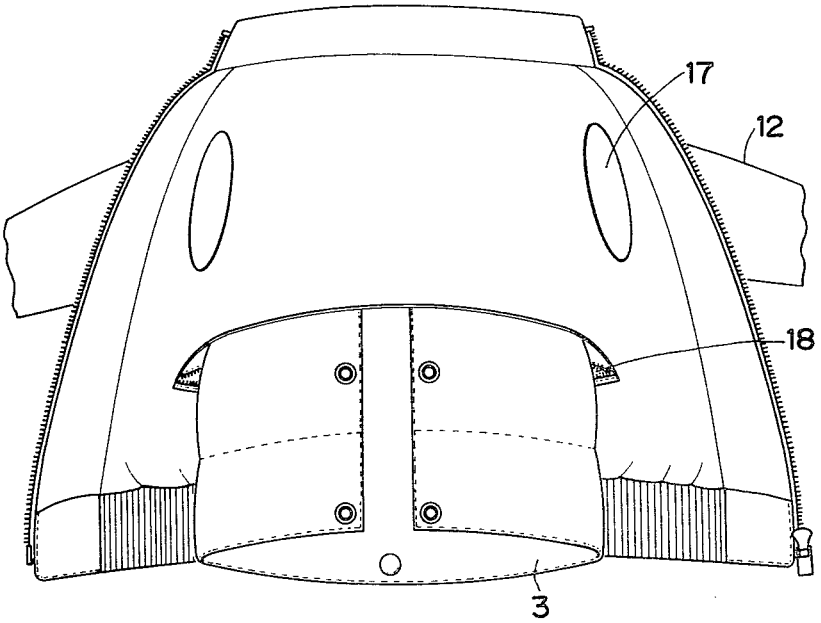
FIGS. 6, 7 and 8 are an explanatory views showing how to attach the liner in the jumper.
Figure 7:
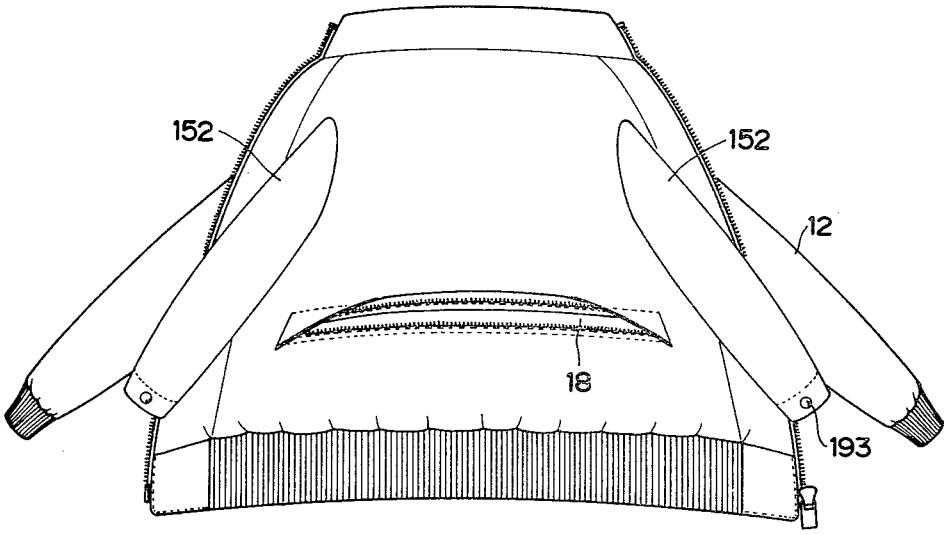
Figure 8:
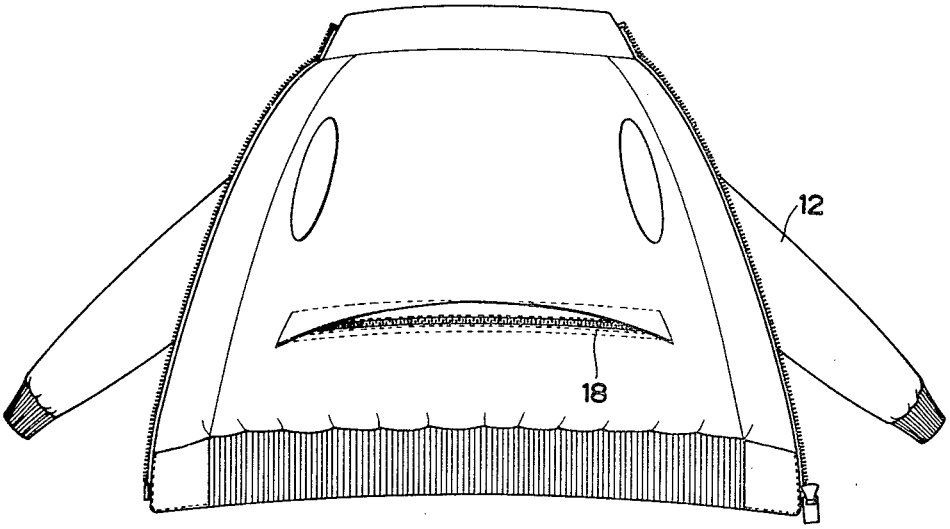
Figure 9:
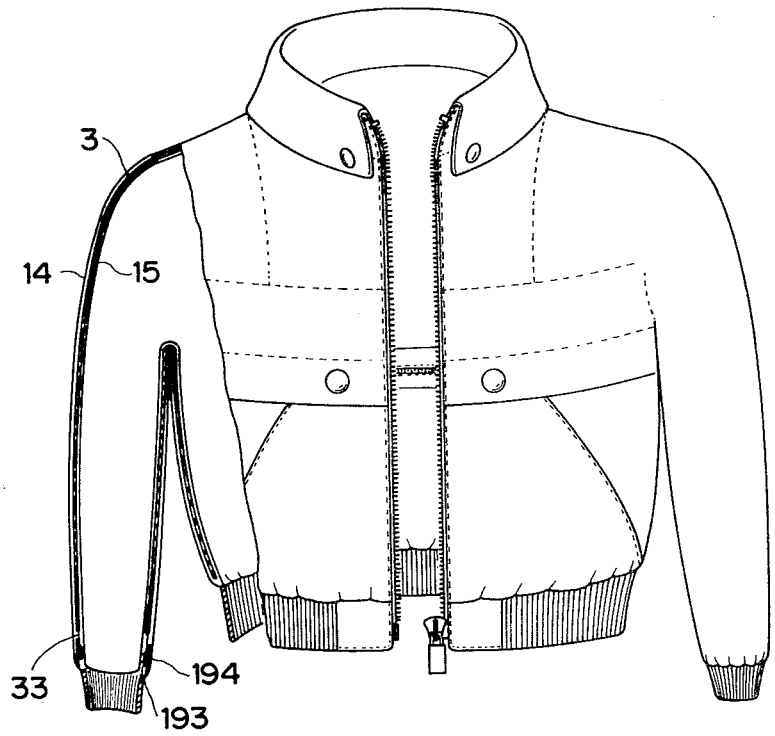
FIG. 9 is a front view, partly in cross section, showing the jumper, wherein the liner has been attached therein.

FIG. 5 illustrates a modification of the liner 3. This liner **3*a* comprises a vest portion 30*a* only and is devoid of sleeve portions. Males of the snap fasteners 191*a* are also provided on the liner 3*a***.

FIGS. 6, 7, 8 and 9 show how to attach the liner 3 in the jumper 1. Firstly, the liner 3 is inserted through the slit 18 and placed in position in the space 16 of the front and back panels 10, 11 of the jumper 1. Then the snap fasteners 19 are fastened, except the snap fasteners 193, 194 provided at the cuffs 13 and 153. Then, after pulling out the sleeve linings 152 (FIG. 7), with its inside out, from the shoulder hole 17, the sleeve portions 31 of the liner 3 are respectively inserted in each sleeve 12 of the jumper through the shoulder hole 17, and then pulled sleeves linings 152 are respectively put back through the shoulder hole 17 in the sleeve portions 31 of the liners 3 once again. The sleeve portions 31 of the liner are fixed in position by fastening the male and female of the snap fastener 193, 194 at the cuff portion such that the loops 33 of the liner 3 are interposed between the snap fastener 193, 194. Finally, the slit 18 is closed and concealed from a view.

In case of removing the liner 3 out of the jumper 1, the procedure will follow the reverse course. Namely, after opening the slit 18, all the snap fasteners 191, 192, 193, 194 are unfastened and the loops 33 are made free. Then the liner 3 is removed out through the slit 18.

When the modified liner **3*a* is used, the procedure is similar but simpler than the above. In this case, the liner 3*a* is inserted through the slit 18 in the space 16 and placed in position. The snap fasteners are then all fastened. The slit 18** is then closed and finished.

With this arrangement, the liner can be detachably attached inside the jumper quickly and easily and stably fixed in position in the jumper. And the jumper made in accordance with the present invention is cold-proof and water-proof, since the quality liner is covered by the exterior side which may be a water-proof finish.

Obviously, many modifications and variations of the present invention are possible in light of the above teaching. It is therefore to be understood, that with the scope of the appended claims, the invention may be practiced otherwise than as specifically described.

I claim:

1. A jumper having a front and back panel and a pair of sleeves extending from the panels, said front panel being openable at its front, which comprises:

(a) a first side constituting an outer face of the front and back panels and sleeves;

(b) a lining constituting an inner face of the front and back panels and sleeves, said lining being stitched to the first side at peripheral edges, excluding said sleeves, of the panels so as to form a space between the first side and the lining, said lining having, at the back panel, a slit which communicates with the space;

(c) a liner including sleeve portions, said liner being detachably insertable in the space through the slit; and (d) means for fixing the liner in position in the space, said means for fixing including releasable fastening means between said first side and said lining at cuffs of said sleeves and means associated with cuffs of said sleeve portions of said liner for attachment of said sleeve portions to said fastening means.

2. A jumper as defined in claim 1, wherein said means for fixing comprises a plurality of snap fasteners on said first side and lining sleeves and a pair of loops on said sleeve portions.

* * * * *